United States Patent [19]

Coleman

[11] 4,244,511

[45] * Jan. 13, 1981

[54] SPECIALTY ENVELOPE SERVING AS A PICTURE FRAME

[75] Inventor: John D. Coleman, Fairport, N.Y.

[73] Assignee: Photomailer, Inc., Rochester, N.Y.

[ * ] Notice: The portion of the term of this patent subsequent to Feb. 5, 1997, has been disclaimed.

[21] Appl. No.: 961,935

[22] Filed: Nov. 20, 1978

Related U.S. Application Data

[63] Continuation-in-part of Ser. No. 901,502, May 1, 1978, Pat. No. 4,186,868.

[51] Int. Cl.[3] ..... B65D 27/14

[52] U.S. Cl. ..... 229/92.1; 40/156; 206/492; 229/92.3; 229/92.7

[58] Field of Search ..... 229/92.8, 92.7, 92.3, 229/80, 92.1; 40/152.1, 158 R1156; 206/460, 492

[56] References Cited

U.S. PATENT DOCUMENTS

| | | | |
|---|---|---|---|
| 1,038,652 | 9/1912 | Reese | 229/92.8 |
| 1,396,724 | 11/1921 | Cameron | 40/152.1 |
| 1,421,097 | 6/1922 | Pente | 229/92.3 |
| 1,720,721 | 7/1929 | Culotta | 229/92.7 |
| 2,316,757 | 4/1943 | Berkowitz | 229/92.7 |
| 2,443,645 | 6/1948 | Turan | 40/152.1 |
| 2,601,530 | 6/1952 | Kegan et al. | 229/92.7 |
| 3,458,034 | 7/1969 | Larson | 229/92.8 X |

*Primary Examiner*—Stephen P. Garbe

*Attorney, Agent, or Firm*—Jones, Thomas & Askew

[57] ABSTRACT

An envelope which may be cut from a single piece of sheet material comprising a plurality of flaps, the front and rear of which are fitted with adhesive strips for sealing and for holding a photograph. The flaps are disposed so that an attached photograph may be covered and protected in the mail. Perforations or die cuts define a removable portion of a writing surface, removal of which makes the photograph visible from outside the envelope. The flaps are cut and disposed so that alternate procedures of refolding and resealing provide a frame for the photograph which may be placed on its side or its end.

8 Claims, 9 Drawing Figures

SPECIALTY ENVELOPE SERVING AS A PICTURE FRAME

DESCRIPTION

CROSS-REFERENCE TO RELATED APPLICATION

This application is a continuation-in-part of my co-pending application Ser. No. 901,502 entitled "Specialty Envelope" filed May 1, 1978, now U.S. Pat. No. 4,186,868.

TECHNICAL FIELD

The present invention relates to envelopes specifically designed for carrying photographs through the mails and more particularly discloses such an envelope which also serves as a picture frame.

BACKGROUND OF THE INVENTION

Since the invention of inexpensive cameras, it has become common for people to provide photographs to accompany and illustrate letters mailed to relatives and friends. More recently, custom made postcards and Christmas cards wherein the front of the card comprises a photograph have been available. The most salient disadvantage of such custom postcards is that the photograph is often damaged during the passage of such postcards through the mails. When photographs are simply included in a conventional envelope along with a letter, they may become separated from the written message and misplaced when the envelope is opened by the recipient.

Envelopes of unitary construction using part of the surfaces used to contain a written message and part for the address are known. Furthermore, envelopes of unitary construction especially designed to contain a written message and advertising materials attached thereto, are also known. An envelope of the latter type is shown in U.S. Pat. No. 1,720,721 to Culotta.

An envelope designed specifically for protecting a photograph during passage through the mails and furthermore to assure that photograph and message do not become separated upon opening of the envelope is described in my co-pending application Ser. No. 901,502 filed May 1, 1978, now U.S. Pat. No. 4,186,868 and entitled "Specialty Envelope". The specification of said co-pending application is hereby incorporated by reference.

For most written messages accompanied by a photograph, it has been found that the recipient's interest in the written message is more ephemeral than his or her interest in the accompanying photograph.

SUMMARY OF THE INVENTION

In view of the greater longevity of interest in a photograph as opposed to a written message, it is considered desirable that a specialty envelope be designed for protecting a photograph during passage through the mails, and also to provide a convenient and attractive means for displaying the photograph once the recipient has read an accompanying message. It is therefore an object of this invention to provide a specialty envelope which will protect a photograph during passage through the mails, assure that the photograph and an accompanying written message do not become separated upon opening by the recipient, and furthermore to provide a convenient picture frame for displaying of the photograph once the recipient has read the accompanying written message. The present invention comprises a speciality envelope which includes a writing surface, two side flaps, a rear flap at one end of the writing surface, and a front flap at the other end of the writing surface having an adhesive strip thereon for application to the back of a photograph or similar object. The photograph and the short front flap may be folded over the writing surface once the message is written. The side flaps are disposed so that they may be folded over the back of the photograph.

A second adhesive strip is provided near the distal end of the rear flap for securely holding the folded specialty envelope together when folded for mailing. According to one aspect of the present invention, a third adhesive strip is provided on the front flap on the side opposite the first adhesive strip. The third adhesive strip may be used to more securely fasten the rear flap to the front flap upon passage through the mails, or may be preserved for later use when the present invention is used as a picture frame.

According to another aspect of the present invention, a portion of the writing surface is perforated so that it may be removed by the recipient after reading a message written thereto. The photograph may then be folded back into the same position it occupied during mailing but will be visible from the outside of the speciality envelope due to the removal of a portion of the writing surface. One or both side flaps may then be left unfolded while the rear flap is again folded to its mailing position and is attached securely to the front flap. By leaving one side flap unfolded, the side flap becomes a base upon which the specialty envelope may be rested so that the photograph may be viewed through the opening in the writing surface. In a similar manner, leaving both side flaps unfolded will leave two edges of the side flaps in a position to serve as a base for supporting the specialty envelope on its end. These and other aspects of the present invention are described below in the detailed description of two alternate preferred embodiments.

DETAILED DESCRIPTION OF THE PREFERRED EMBODIMENTS

Figure 1:
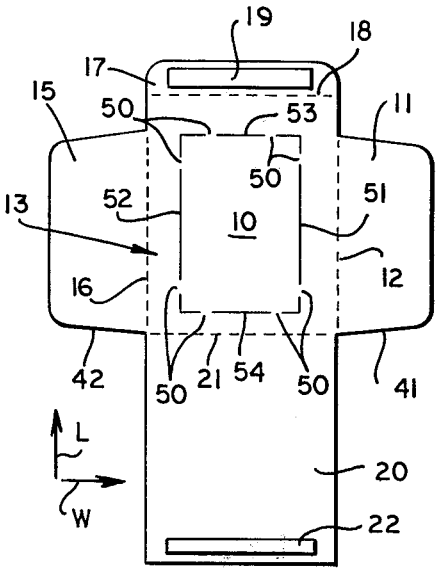
FIG. 1 is a plan view of a first preferred embodiment of the present invention.
Figure 2:
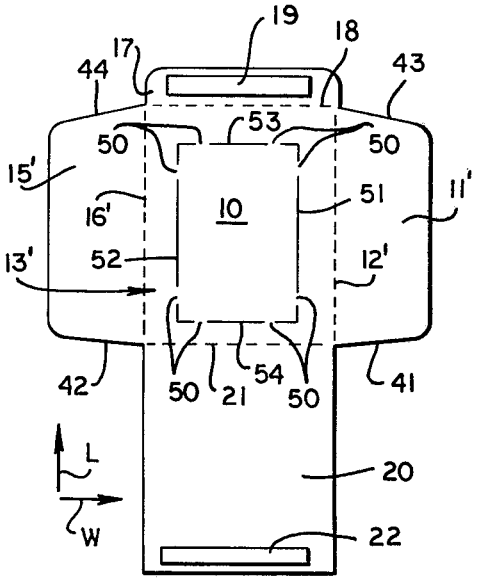
FIG. 2 is a plan view of an alternate preferred embodiment of the present invention.

Turning first to FIGS. 1 and 2, plan views of the first preferred embodiment and the alternate preferred embodiment are shown. Throughout this specification length dimensions will be defined as those measured along lines parallel to line L as shown in FIGS. 1 and 2, and width dimensions will be referred to as dimensions parallel to line W shown in FIGS. 1 and 2. Also the upper surface of each component of the preferred embodiments will be that surface visible in the plan views FIGS. 1 and 2, and the lower surface of each component will be that surface opposite the upper surface.

As may be seen from FIGS. 1 and 2, the preferred embodiments of the present invention include a writing surface 13 having a removable portion thereof 10 bounded by lines 51, 52, 53, and 54. Lines 51–54 are die cut in the preferred embodiment and the removable portion 10 of writing surface 13 bounded by lines 51–54 is held in place by a plurality of uncut portions noted as 50 in FIGS. 1 and 2. As may be seen from FIGS. 1 and 2, lines 51–54 comprise a plurality of cuts bounding the removable portion 10 of writing surface 13. Of course any suitable means for defining a removable portion of writing surface 13 may be used. For example, evenly distributed perforations along lines 51–54 could be used in place of die cuts with uncut portions 50 as shown in the preferred embodiments.

The preferred embodiments of the present invention also include a front flap 17, having disposed thereon an adhesive strip 19; a rear flap 20 having disposed thereon a second adhesive strip 22, and side flaps shown as 11 and 15 in the first preferred embodiment and 11' and 15' in the alternate preferred embodiment. The preferred embodiments use conventional two-sided adhesive strips for adhesive strips 19 and 22. One side of said adhesive strip is attached to the upper surface of the flap upon which said strip is disposed, and the exposed remaining side is left covered until the cover is removed by the ultimate user of the present invention. Of course any adhesive material such as cellophane tape, glue, or paste may be used in construction of an embodiment of the present invention.

In the preferred embodiments shown, rear flap 20 is of substantially the same length as writing surface 13. However, in order to embody the protective features of the present invention it is only necessary that the sum of the lengths of front flap 17 and rear flap 20 be greater than the length of writing surface 13. This assures that the entire writing surface and the back of photograph 40 will be adequately protected in passage through the mail. As may be seen from FIGS. 1 and 2, right side flaps 11 and 11' each include a bottom edge 41. Similarly, left side flaps 15 and 15' each include a bottom edge 42. As may be seen from FIGS. 1 and 2, edges 41 and 42 in the preferred embodiments are cut so that a line drawn along each of edges 41 and 42 forms an acute angle with a line extending from crease 21.

In the alternate preferred embodiment show in FIG. 2, side flaps 11' and 15' include top edges 43 and 44, respectively. A line drawn along either of edges 43 and 44 intersects a line drawn along crease 18 at an acute angle.

USE OF THE PRESENT INVENTION

Figure 3:
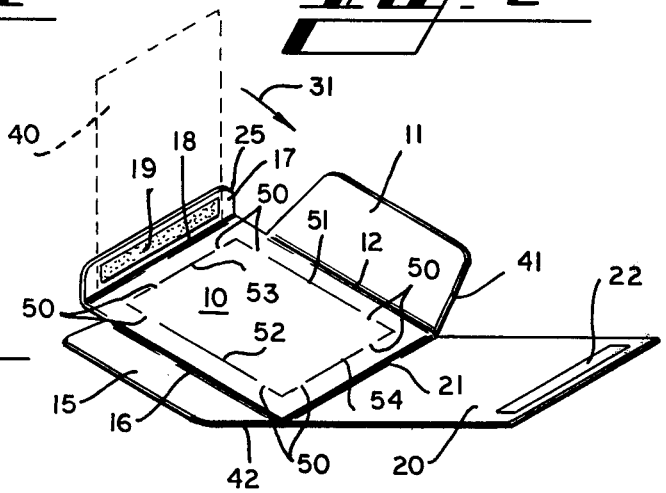
FIG. 3 is a pictorial view of the first preferred embodiment of the present invention.

FIG. 3 shows the first preferred embodiment of the present invention with a photograph 40 shown in phantom attached to the upper surface of front flap 17 by adhesive strip 19. It is assumed that writing surface 13 contains a written message thereon as written by the user. Of course the upper surface of rear flap 20 as well as the upper surfaces of side flaps 11 and 15 may also be used to hold portions of a written message since all of said upper surface will be hidden from view when the envelope is ultimately sealed for deposit in the mail.

Figure 4:
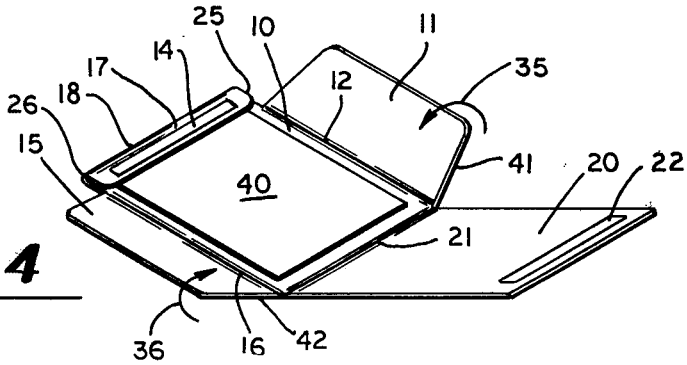
FIG. 4 is a pictorial view of the first preferred embodiment of the present invention with the front flap and a photograph folded over the writing surface.

FIG. 4 shows the first preferred embodiment of the present invention with the photograph 40 folded over writing surface 13 in a direction indicated by arrow 31 in FIG. 3. FIG. 4 also shows a third adhesive strip 14 disposed on the lower surface of front flap 17.

To complete closure of the specialty envelope for mailing, side flaps 11 and 15 are folded inwardly along creases 12 and 16 in the directions shown by arrows 35 and 36 respectively in FIG. 4. The final step is to fold rear flap 20 in the direction shown by arrow 37 in FIG. 5.

Figure 5:
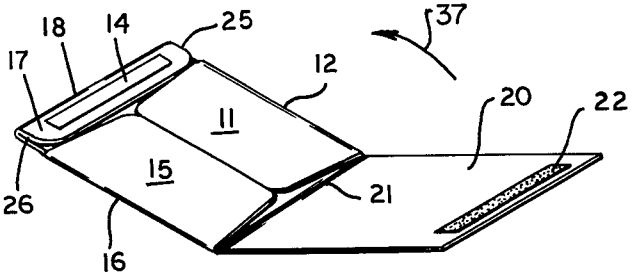
FIG. 5 is a pictorial view of the first preferred embodiment of the present invention shown with the front flap and the side flaps folded over the writing surface.

Note that FIG. 5 also shows third adhesive surface 14 disposed on the lower surface of front flap 17. In the preferred embodiments of the present invention, third adhesive strip 14 may have the protective strip thereof removed prior to sealing so that adhesive strips 14 and 22 are urged together forming a very secure seal when rear flap 20 is folded over side flaps 11 and 15.

Alternately, the protective strip may be left on adhesive strip 14 by the sender, and removed by the recipient of the specialty envelope. When the recipient is refolding the specialty envelope of the present invention for use as a frame, as is described hereinbelow, the recipient may then remove the protective strip of adhesive strip 14 in order to then form a tight seal between adhesive strips 14 and 22.

As will be apparent to those skilled in the art, third adhesive strip 14 may be used in lieu of second adhesive strip 22 and secure closure of the specialty envelope may still be obtained.

The folded and sealed specialty envelope of the present invention provides a secure and sturdy means for transporting photograph 40 through the mail and prevents damage to the surface of photograph 40 since it is completely enclosed within the specialty envelope.

The recipient of the specialty envelope will open it by reversing the steps described above so that he or she is presented with the envelope and photograph substantially as shown in FIG. 3. Once the written message has been read, the recipient may then transform the present invention into a convenient and attractive frame for photograph 40 by executing the following steps. First the movable portion 10 of writing surface 13 is removed by breaking uncut portions 50. This leaves a hole in writing surface 13 bounded by lines 51, 52, 53 and 54. The recipient then folds photograph 40 and front flap 17 along crease 18 in the direction shown by arrow 31 in FIG. 3. This will cause the face of photograph 40 to appear in the opening bounded by lines 51–54 when the lower surface of the remainder of writing surface 13 is viewed.

Figure 6:
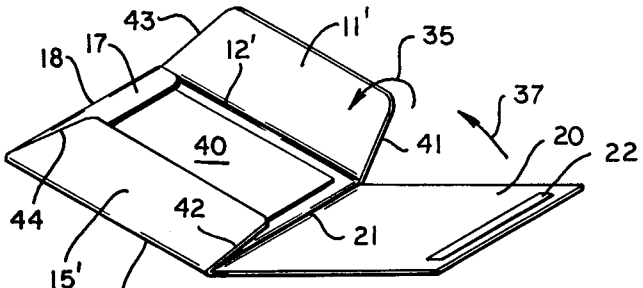
FIG. 6 is a pictorial view of the alternate preferred embodiment of the present invention with one side flap and the rear flap remaining unfolded.
Figure 9:
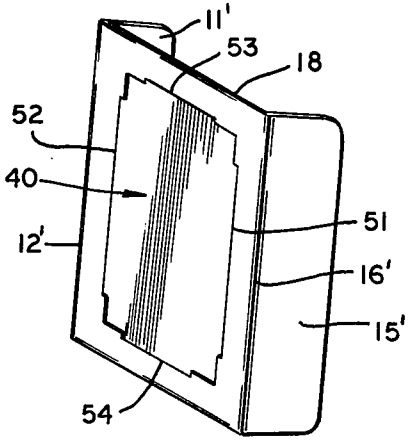
FIG. 9 is a pictorial view of the alternate preferred embodiment folded as shown in FIG. 8 and serving as a frame for a photograph whose height is greater than its breadth.

FIGS. 6–9 show the alternate preferred embodiment of the present invention and its configuration as the frame for photograph 40. The next step to be executed by the recipient is to fold left side flap 15' over front flap 17 and the back of photograph 40 as shown in FIG. 6.

The remaining steps in creation of the convenient frame depend upon the nature of photograph 40. If photograph 40 is one having a breadth greater than its height, then the next step for the recipient is to fold rear flap 20 in direction 37 as shown in FIG. 6. This leaves right side flap 11' protruding from the otherwise completely closed envelope and photograph combination as shown in FIG. 7.

The preferred embodiments of the present invention are constructed from cardboard or lightweight plastic, but any suitable material may be used. It will be apparent to those skilled in the art, that use of such materials will cause crease 12' as shown in FIG. 6 to have enough flexibility so that flap 11' may be folded along crease 12' but that crease 12' will also have enough stiffness so that right side flap 11' may support the weight of the remainder of the envelope and photograph combination as shown in FIG. 7. If a lighter weight material is used, a support member may be added between side flap 11' and rear flap 20.

Figure 7:
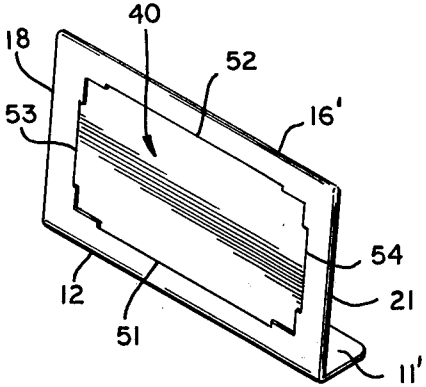
FIG. 7 is a pictorial view of the alternate preferred embodiment of the present invention serving as a frame for a photograph the breadth of which is greater than the height.

In FIG. 7 it may be seen that right side flap 11' is used as a base for the specialty envelope containing photograph 40 and that by refolding and sealing the envelope as described hereinabove, a convenient and attractive frame is provided to the recipient of the written message and photograph.

Figure 8:
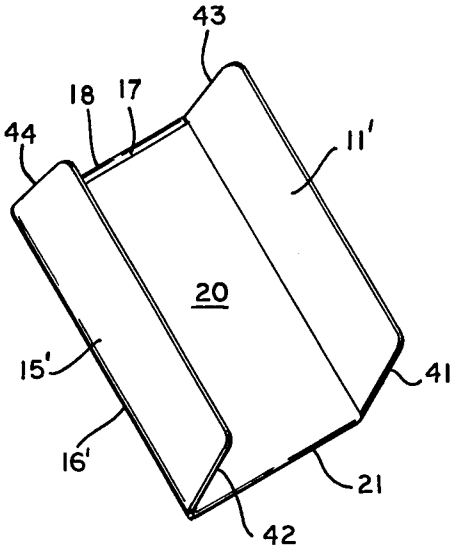
FIG. 8 is a pictorial view of the alternate preferred embodiment of the present invention with the front and rear flaps folded over the writing surface and the side flaps remaining unfolded.

If photograph 40 is one whose height is greater than its breadth, an alternate last step must be used to refold and reseal the envelope in order to create a frame. Instead of folding the left side flap 15' down as shown in FIG. 6, side flaps 11' and 15' should be left open, and rear flap 20 should be folded over photograph 40 in the direction of arrow 37 as shown in FIG. 6. This produces a sealed envelope substantially as shown in FIG. 8 with side flaps 11' and 15' protruding from the otherwise sealed envelope and photograph combination.

Recall that bottom edges 41 and 42 of side flaps 11' and 15' respectively form an acute angle with a line drawn along crease 21 as was described above, and as may be seen from FIG. 2. Thus, when the resealed envelope is placed on a level surface on crease 21 and bottom edges 41 and 42, the plane in which photograph 40 lies will be tilted slightly back toward side flaps 11' and 15' from a perpendicular to the surface upon which edges 41 and 42 rest. Thus it may be seen that a convenient and attractive frame is provided for a photograph whose height is greater than its breadth. Similarly, an envelope constructed according to the alternate preferred embodiment shown in FIG. 2 may be resealed and placed on edges 43 and 44, and crease 18.

From the foregoing it will be apparent that specialty envelope of the present invention provides the advantages of completely protecting a photograph in passage through the mails, securing the photograph to an accompanying written message when the envelope is opened by the recipient and a convenient and attractive frame which may be implemented simply by removing the removable portion of the writing surface and refolding and resealing the envelope. It may also be seen that the present invention will provide such a convenient frame to the recipient without regard to whether the photographer shot the accompanying photograph in such a manner that its height was greater than its breadth or vice versa.

It will be understood by those skilled in the art that the foregoing description of the preferred embodiments are examples of the present invention and that other embodiments which provide the advantages set forth herein are possible. Therefore the scope of the present invention should be limited only by the claims appended hereto.

I claim:

1. An envelope assembly comprising a writing surface;

said writing surface including a removable section comprising a portion of said writing surface bounded by a plurality of cuts;

a right side flap disposed so that said right side flap may be folded to cover a portion of said writing surface;

a left side flap disposed so that said left side flap may be folded to cover a portion of said writing surface;

a front flap including a lower surface, and including a front flap upper surface with a first adhesive means disposed on said front flap upper surface for fastening a foreign object to said front flap;

a rear flap having an area substantially equal to the area of said writing surface and including a rear flap upper surface;

said rear flap being disposed so that it may be folded to cover substantially all of said writing surface;

second adhesive means disposed on said rear flap upper surface near the distal end of said rear flap for attaching said rear flap upper surface to said lower surface when said rear flap is folded over said writing surface subsequent to said front flap being folded over said writing surface;

wherein said front flap is jointed to said writing surface along a crease defining a first straight line;

said left side flap is characterized by a first top edge defining a second straight line;

said right side flap is characterized by a second top edge defining a third straight line; and said second straight and said third straight line each intersect said first straight line to form an acute angle.

2. An envelope as recited in claim 1 wherein:

said rear flap is joined to said writing surface along a crease defining a first straight line;

said left side flap is characterized by a first bottom edge defining a second straight line;

said right side flap is characterized by a second bottom edge defining a third straight line; and said second straight line and said third straight line each intersect said first straight line to form an acute angle.

3. An envelope assembly comprising a writing surface having a first length, a right side flap disposed so that said right side flap may be folded to cover a portion of said writing surface;

said writing surface including a removable section comprising a portion of said writing surface bounded by a plurality of cuts;

a left side flap disposed so that said left side flap may be folded to cover a portion of said writing surface;

a front flap having a second length, said front flap comprising a lower surface and a front flap upper surface with a first adhesive means disposed on said front flap upper surface for fastening a foreign object to said front flap;

a rear flap having a third length and including a rear flap upper surface;

said rear flap being disposed so that it may be folded to cover a portion of said writing surface;

second adhesive means disposed on said rear flap upper surface near the distal end of said rear flap for attaching said rear flap upper surface to said lower surface when said rear flap is folded over said writing surface subsequent to said front flap being folded over said writing surface;

wherein the sum of said second length and said third length is greater than said first length;

said front flap is jointed to said writing surface along a crease defining a first straight line;

said left side flap is characterized by a first top edge defining a second straight line;

said right side flap is characterized by a second top edge defining a third straight line; and said second straight and said third straight line each intersect said first straight line to form an acute angle.

4. An envelope as recited in claim 3 wherein:

said rear flap is joined to said writing surface along a crease defining a first straight line;

said left side flap is characterized by a first bottom edge defining a second straight line;

said right side flap is characterized by a second bottom edge defining a third straight line; and said second straight line and said third straight line each intersect said first straight line to form an acute angle.

5. An envelope assembly comprising a writing surface having a first length, a right side flap disposed so that said right side flap may be folded to cover a portion of said writing surface;

a left side flap disposed so that said left side flap may be folded to cover a portion of said writing surface;

said writing surface including a removable section comprising a portion of said writing surface bounded by a plurality of cuts;

a front flap having a second length, having a lower surface, and having a front flap upper surface with a first adhesive means disposed thereon for fastening a foreign object to said front flap;

a rear flap having a third length and having a rear flap upper surface;

said rear flap being disposed so that it may be folded to cover a portion of said writing surface;

second adhesive means disposed on said front flap lower surface for attaching said rear flap upper surface to said lower surface when said rear flap is folded over said writing surface subsequent to said front flap being folded over said writing surface; and wherein the sum of said second length and said third length is greater than said first length.

6. The envelope assembly of claim 5 further comprising:

third adhesive means disposed on said rear flap upper surface for engaging said second adhesive means when said rear flap is folded over said writing surface subsequent to said front flap being folded over said writing surface.

7. An envelope as recited in claim 5 wherein:

said rear flap is joined to said writing surface along a crease defining a first straight line;

said left side flap is characterized by a first bottom edge defining a second straight line;

said right side flap is characterized by a second bottom edge defining a third straight line; and said second straight line and said third straight line each intersect said first straight line to form an acute angle.

8. An envelope as recited in claim 5 wherein said front flap is jointed to said writing surface along a crease defining a first straight line;

said left side flap is characterized by a first top edge defining a second straight line;

said right side flap is characterized by a second top edge defining a third straight line; and said second straight and said third straight line each intersect said first straight line to form an acute angle.

* * * * *